US009597916B2

(12) United States Patent
Begin et al.

(10) Patent No.: US 9,597,916 B2
(45) Date of Patent: Mar. 21, 2017

(54) MOTORIZED GIFT CARD HOLDERS

(71) Applicant: American Greetings Corporation, Cleveland, OH (US)

(72) Inventors: Anthony Begin, Cleveland, OH (US); David Mayer, Bay Village, OH (US); Terry Hughes, Avon, OH (US); Jerry Guo, Shanghai (CN); Tiger Qiao, Shanghai (CN); John Talbot, Bay Village, OH (US); Donald Zhang, Shenzhen (CN)

(73) Assignee: American Greetings Corporation, Cleveland, OH (US)

( * ) Notice: Subject to any disclaimer, the term of this patent is extended or adjusted under 35 U.S.C. 154(b) by 161 days.

(21) Appl. No.: 14/664,996

(22) Filed: Mar. 23, 2015

(65) Prior Publication Data

US 2015/0197117 A1 Jul. 16, 2015

Related U.S. Application Data

(63) Continuation-in-part of application No. 13/447,458, filed on Apr. 16, 2012, now abandoned, which is a continuation-in-part of application No. 12/940,145, filed on Nov. 5, 2010, now Pat. No. 8,230,624, application No. 14/664,996, which is a continuation-in-part of application No. 14/228,757, filed on Mar. 28, 2014, now Pat. No. 9,248,688, which is a continuation-in-part of application No. 13/873,033, filed on Apr. 29, 2013, now Pat. No. 8,857,082, which is a continuation-in-part of application No. 13/743,806, filed on Jan. 17, 2013, now Pat. No. 8,490,306, which is a continuation-in-part of application No. 13/447,403, (Continued)

(51) Int. Cl.

| | |
|---|---|
| ***G09F 1/00*** | (2006.01) |
| ***B42D 15/02*** | (2006.01) |
| *B42D 15/04* | (2006.01) |

(52) U.S. Cl.

CPC ..... *B42D 15/022* (2013.01); *B42D 15/027* (2013.01); *B42D 15/042* (2013.01)

(58) Field of Classification Search

None

See application file for complete search history.

(56) References Cited

U.S. PATENT DOCUMENTS 7,552,553 B2 * 6/2009 Kelly ..... B42D 15/045 40/124.08

7,861,441 B1 * 1/2011 Hoellwarth ..... B42D 15/08 229/92.8

(Continued)

*Primary Examiner* — Kristina Junge

(74) *Attorney, Agent, or Firm* — Christine Flanagan

(57) ABSTRACT

The present disclosure and related inventions are directed to various types of motorized gift card holders. Each gift card holder embodiment creates added entertainment value to the act of presenting a recipient with a gift card. In some embodiments, the gift card holder is in the form of a greeting card having a motor therein to which a gift card or gift card sleeve is attached. In other embodiments, the gift card holder is in the form of a box having a motor therein to which a gift card or gift card sleeve is attached. Audio playback accompanies the motor movement of the gift card or gift card sleeve.

12 Claims, 10 Drawing Sheets

Related U.S. Application Data filed on Apr. 16, 2012, now Pat. No. 9,009,998, which is a continuation-in-part of application No. 12/940,145, filed on Nov. 5, 2010, now Pat. No. 8,230,624, application No. 14/664,996, which is a continuation-in-part of application No. 14/535,129, filed on Nov. 6, 2014.

(60) Provisional application No. 61/286,184, filed on Dec. 14, 2009, provisional application No. 61/902,496, filed on Nov. 11, 2013.

(56) References Cited

U.S. PATENT DOCUMENTS

| | | | | |
|---|---|---|---|---|
| 8,499,478 | B1 * | 8/2013 | Glass | B42D 25/22 40/124.08 |
| 2007/0256337 | A1 * | 11/2007 | Segan | B42D 15/045 40/124.03 |
| 2009/0126239 | A1 | 5/2009 | Clegg | |
| 2010/0052876 | A1 * | 3/2010 | Clegg | B42D 15/022 340/384.1 |
| 2011/0146117 | A1 * | 6/2011 | Mayer | B42D 15/022 40/124.03 |
| 2013/0232828 | A1 | 9/2013 | Qiao et al. | |
| 2015/0224808 | A1 | 8/2015 | Shlonsky et al. | |
| 2015/0279240 | A1 | 10/2015 | Fluharty | |
| 2015/0279241 | A1 | 10/2015 | Kershner et al. | |

* cited by examiner

MOTORIZED GIFT CARD HOLDERS

RELATED APPLICATIONS

This application is a continuation-in-part of U.S. patent application Ser. No. 13/447,458, filed on Apr. 16, 2012, which is a continuation-in-part of U.S. patent application Ser. No. 12/940,145, filed on Nov. 5, 2010 (now U.S. Pat. No. 8,230,624, issued on Jul. 31, 2012), which is a non-provisional of U.S. Provisional Patent Application No. 61/286,184, filed on Dec. 14, 2009.

This application is also a continuation-in-part of U.S. patent application Ser. No. 14/228,757, filed on Mar. 28, 2014, which is a continuation-in-part of U.S. patent application Ser. No. 13/873,033, filed on Apr. 29, 2013 (now U.S. Pat. No. 8,857,082, issued on Oct. 14, 2014), which is a continuation-in-part of U.S. patent application Ser. No. 13/743,806, filed on Jan. 17, 2013 (now U.S. Pat. No. 8,490,306, issued on Jul. 23, 2013), which is a continuation-in-part of U.S. patent application Ser. No. 13/447,403, filed on Apr. 16, 2012, which is a continuation-in-part of U.S. patent application Ser. No. 12/940,145, filed on Nov. 5, 2010 (now U.S. Pat. No. 8,230,624, issued on Jul. 31, 2012), which is a non-provisional of U.S. Provisional Patent Application No. 61/286,184, filed on Dec. 14, 2009.

This application is also a continuation-in-part of U.S. patent application Ser. No. 14/535,129, filed on Nov. 6, 2014, which is a non-provisional of U.S. Provisional Patent Application No. 61/902,496, filed on Nov. 11, 2013.

FIELD OF THE INVENTION

This invention is in the field of social expression products. More specifically, this invention is directed to gift packaging in the form of gift card holders having motorized movement.

SUMMARY OF THE INVENTION

The present disclosure and related inventions are directed to various types of motorized gift card holders. Each gift card holder embodiment creates added entertainment value to the act of presenting a recipient with a gift card. In some embodiments, the gift card holder is in the form of a greeting card having a motor therein to which a gift card or gift card sleeve is attached. In other embodiments, the gift card holder is in the form of a box having a motor therein to which a gift card or gift card sleeve is attached. Audio playback accompanies the motor movement of the gift card or gift card sleeve.

DETAILED DESCRIPTION OF PREFERRED AND ALTERNATE EMBODIMENTS

Figure 1:
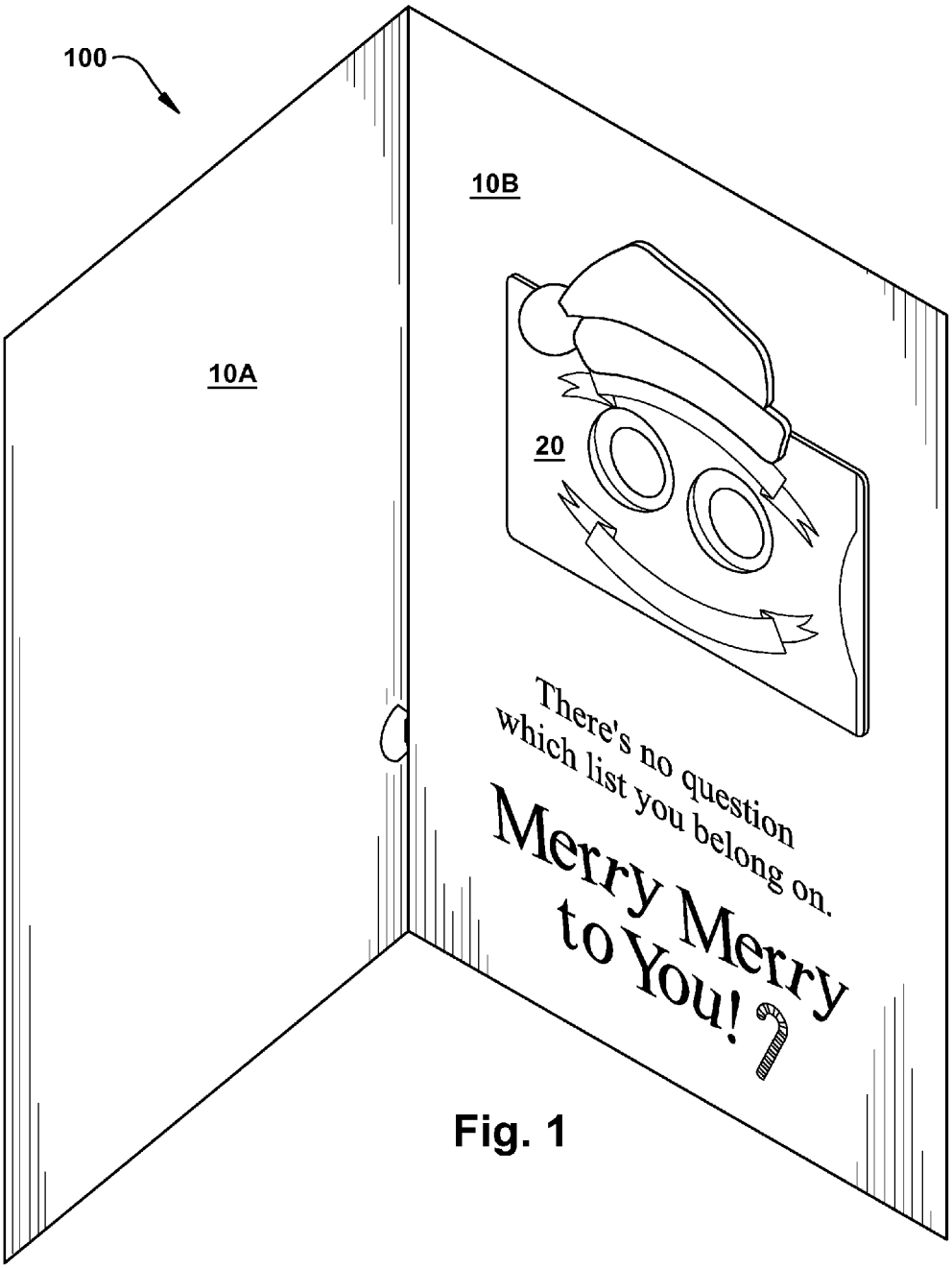
FIG. 1 is a perspective view of a first embodiment of a motorized gift card holder of the present invention, in an open position.

The present disclosure and related inventions are directed to gift packaging in the form of gift card holders. Gift card holders can come in the form of a greeting card having some type of attachment mechanism such as slots, a sleeve, a pocket, glue, etc. in or onto which a greeting card may be placed. Gift card holders can also come in the form of a gift box or other such carrying or holding device. Each of the gift card holders described herein contain a small motor which when activated causes movement to a mobile element located somewhere on the greeting card. In many embodiments, the gift card itself is in some way, either directly or indirectly, attached to the motor causing movement of the actual gift card itself. Various embodiments which include a variety of packaging options and a variety of special effects are described herein. The embodiments described herein each add extra entertainment value to the process of gifting a gift card to a recipient.

As used herein, the term "gift card" is defined as being a restricted monetary equivalent issued by retailers or banks to be used as an alternative to a non-monetary gift. Gift cards are legal tender purchased for use by a consumer and useable in its face amount in lieu of cash in exchange for goods and services supplied by the seller. Gift cards typically resemble a credit card or display a specific theme on a plastic card having a magnetic strip or bar code thereon (typically on the back surface thereof) which contains the dollar amount of the gift card. This amount is rarely stored on the card itself but instead stored in a database controlled by the seller and cross-linked to the ID stored on the magnetic strip or bar code. "Open loop" gift cards are issued by banks or credit card companies and can thus be redeemed at different establishments. "Closed loop" gift cards are issued by a specific retailer or restaurant and can only be redeemed by the issuing provider. Gift cards can be "reloadable" wherein once the dollar amount has been used, additional amounts can be added to the card such that the same gift card can be used multiple times. The term "gift card" can be used interchangeably with the term "transaction card". While not all gift cards are stored value cards (dollar amount actually stored on the card itself), stored value cards are intended to be included under the term "gift cards" as used herein.

While the present invention is deemed "motorized gift card holders", the embodiments described herein are also intended to cover other non-gift card items which can be held in the "gift card sleeve" or other holding or containment mechanism described herein for holding a gift card. Such non-gift card items include, but are not limited to: cash, gift certificates, checks, vouchers, coupons, notes, lottery tickets, tickets to entertainment events (e.g. sporting events, movies, concerts, lectures, conferences, etc.) calling cards, business cards, collectable cards, small gift items, and cards or coins or other substrate with a QR code, digital watermark, bar code (or other digital code or mark which can be decoded printed thereon) having stored therein or being linked to digital or electronic content such as games, music, videos, movies, books, magazine subscriptions, photographs, or other such digital content.

In each of the motorized gift card holder embodiments described herein, a small motor is typically concealed within the body of the gift card holder. The body may be in the form of a traditional greeting card having one or more greeting card panels or may be in the form of a box, a pocket, a sleeve or other such container. In all cases, a small motor is concealed within the body of the gift card holder. The motor is relatively small and lightweight so as to fit within each gift card holder and not add significantly to the weight or bulk of said gift card holder. As an example, the motors may be of the type shown in FIGS. 10 and 14 through 17. In one example, the motor includes a rotating arm or shaft which may be an offset shaft which creates oscillatory motion upon rotation of the shaft by the motor. A lightweight attachment mechanism is attached at one side to the rotating arm or shaft of the motor and at an opposite side to a mobile object. The motor may alternatively have a rotating gear mechanism that when activated turns a circular gear. A connecting rod is located between and connects the gear and the mobile object. As the gear is rotated by the gear mechanism, it in turn causes the mobile object to rotate or spin. These examples of various miniature motor types are set forth herein as an illustration only and is not meant to limit the invention in any way. Any type of small, lightweight motor can be used.

Figure 2:
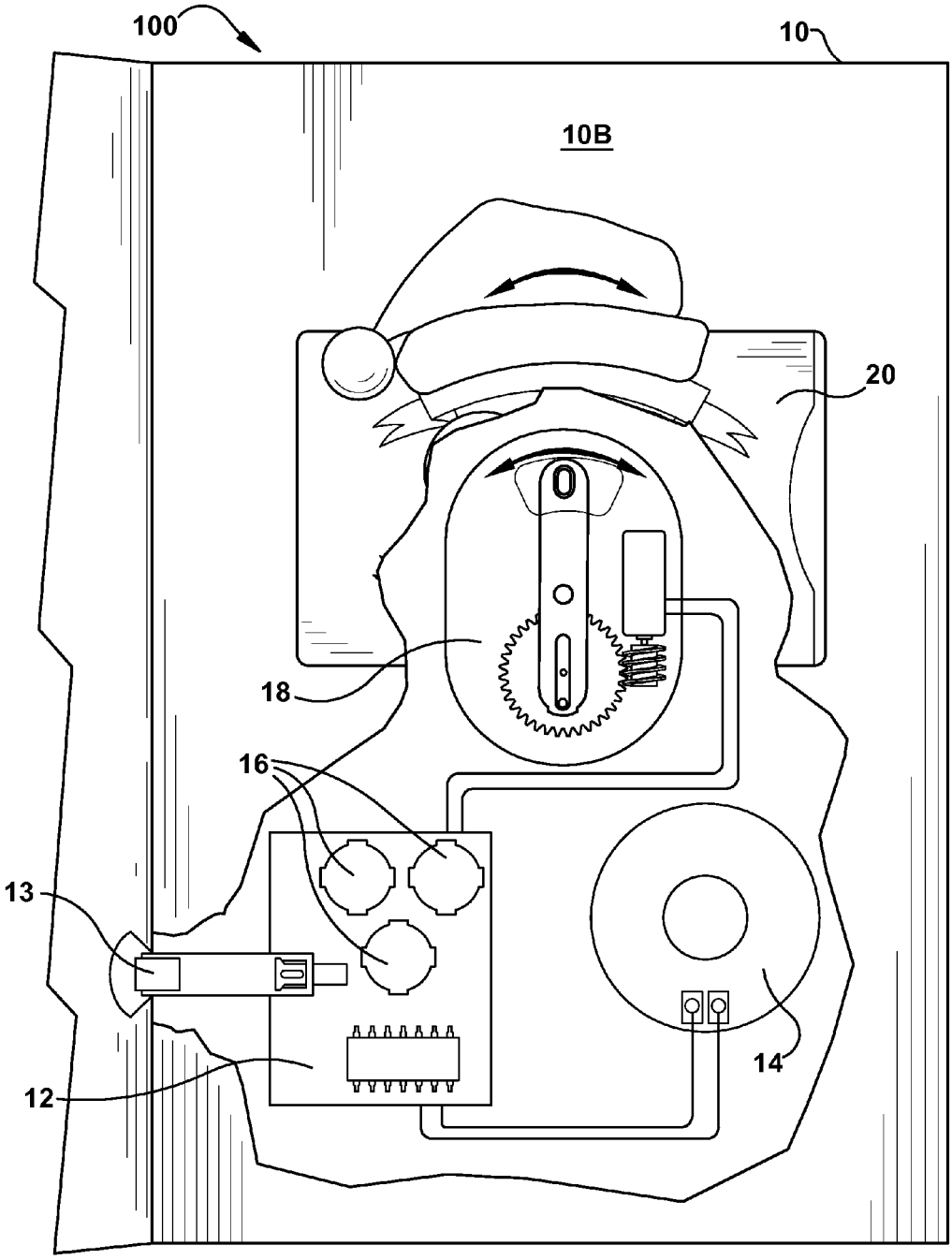
FIG. 2 is a front tear-away view of the gift card holder of FIG. 1.

In a first embodiment, shown in FIGS. 1 and 2, the gift card holder 100 is in the form of a greeting card 10 having three panels. Each panel contains a front surface and a rear surface opposite the front surface. A first panel 10A is attached to a second panel (not shown) along a first fold line and a third panel 10B is attached to the second panel (not shown) along a second fold line. The third (rightmost) panel 10B is folded over the second (center) panel about the second fold line such that the front surface of the third panel 10B is facing the front surface of the second panel. The third panel 10B is attached, adhesively or otherwise, to the second panel about each free perimeter edge, creating a closed pocket or cavity therebetween. The rear surface of the first panel 10A serves as the front cover of the greeting card 10 as it is folded over the second and third 10B panels (which are attached) along the first fold line. The front surface of the first panel 10A serves as the inside left panel of the greeting card 10. The rear surface of the third panel 10B serves as the inside right panel of the greeting card 10 and the rear surface of the second panel serves as the back or rear cover of the greeting card 10. The first panel (or front cover of the greeting card) 10A may contain an opening thereon through which a portion of the inside right panel (and attached gift card) is visible. Various electronic components of the greeting card are contained within the closed pocket or cavity created between the second and third greeting card panels. The electronic components may include, but are not limited to: a printed circuit board 12, an integrated circuit chip, a speaker 14, a switch, a power source such as one or more batteries 16, a motor 18, a memory device and related circuitry and wiring. Any other component which is required to or which facilitates audio capabilities, motor movement, or any other special effect, such as lighting, may be included, such components being known to one having skill in the art. A gift card sleeve or pocket 20 having three closed sides and one open side is attached to the motor 18 via a connecting rod or arm through an opening in the third panel 10B of the greeting card 10 (inside right panel) so that the gift card sleeve or pocket 20 is located on the inside right panel of the greeting card 10. In a preferred embodiment, the gift card sleeve or pocket 20 is rectangular shaped (similar but slightly larger than the size of a traditional gift card) having an opening along the right edge thereof for insertion and removal of the gift card. The front surface of the gift card sleeve or pocket 20 may be completely or partially transparent so that the recipient can view a gift card contained with the gift card sleeve or pocket 20. The opening on the gift card sleeve or pocket 20 may alternatively be placed along the top edge of the sleeve. Also, instead of having a sleeve or pocket 20 with an open edge, the sleeve or pocket 20 may have a flap which can be lifted to reveal a gift card inside the sleeve or pocket or a slot which can be contained on a front face of the sleeve or pocket 20 or any such opening for inserting and removing a gift card. The gift card pocket or sleeve 20 may contain printed indicia thereon or may contain embellishments such as googly eyes 22, a Santa Claus hat, a birthday party hat, or other such embellishments. The gift card sleeve or pocket 20 is attached either directly to the motor 18 or to a connection arm which is also attached to the motor 18. In a preferred embodiment, the greeting card 10 contains a slide switch 13 attached to the greeting card 10 across the first fold line so that when the greeting card 10 is opened but unfolding the first panel (cover panel) 10A away from the second and third 10B panels (rear panel), the slide switch 13 completes the circuit causing activation of the motor module, thereby putting the gift card pocket or sleeve 20 in motion. The motion may be an up-and-down bouncing or vibrating motion, a back-and-forth motion or a circular rotating or spinning motion. In addition to activating the motor 20, the slide switch 13 may also control activation of a sound module which causes audio to be emitted from the speaker 14. At least one audio file may be contained on a memory device within the greeting card 10. Alternatively, the greeting card 10 may contain additional components such as a microphone and recording device which can be implemented to allow a user to record a personalized message for playback upon opening the greeting card. When the greeting card 10 is presented to a recipient, the gift card sleeve or pocket 20 is visible through an opening on the front panel 10A of the greeting card 10. Opening the greeting card 10 initiates the motor 18 and sound module so that the gift card sleeve or pocket 20 (and gift card contained therein) begin moving and audio is emitted through the speaker 14. The motor 18 and sound will continue until a certain predetermined period of time or until the user closes the greeting card 10. While the greeting card/gift card holder has been described herein as having a slide switch which activates the motor and sound module upon opening the greeting card, other switch mechanisms may be used such as a push-button switch, a touch sensitive switch, a light sensitive switch, an audio sensitive switch, a motion-sensitive switch, or any other type of switch mechanism. Also, the greeting card may contain a different number of greeting card panels than what has been disclosed herein with respect to the preferred embodiment. The gift card sleeve or pocket may have a different shape or insertion and removal method than those described herein. Such changes or substitutions have been contemplated and are considered to be within the scope of the present invention. Also, instead of the gift card holder being in the form of a greeting card, the gift card holder may alternatively be in the form of a gift bag. The gift bag being shaped like a traditional gift bag having four side panels, one closed end and one open end for inserting and removing gifts or other items therefrom. One of the gift bag panels may be double-walled with a cavity between the two walls of the panel wherein the motor and other electronic components (mentioned above) may be contained. The gift card sleeve is attached to the motor through an opening in the gift bag such that the gift card sleeve is contained on the outside of the gift bag. A press button, or other type of switch may be used in place of the slide switch described above. In an alternate configuration, this embodiment may also be contained within a gift box instead of greeting card or gift bag.

Figure 3:
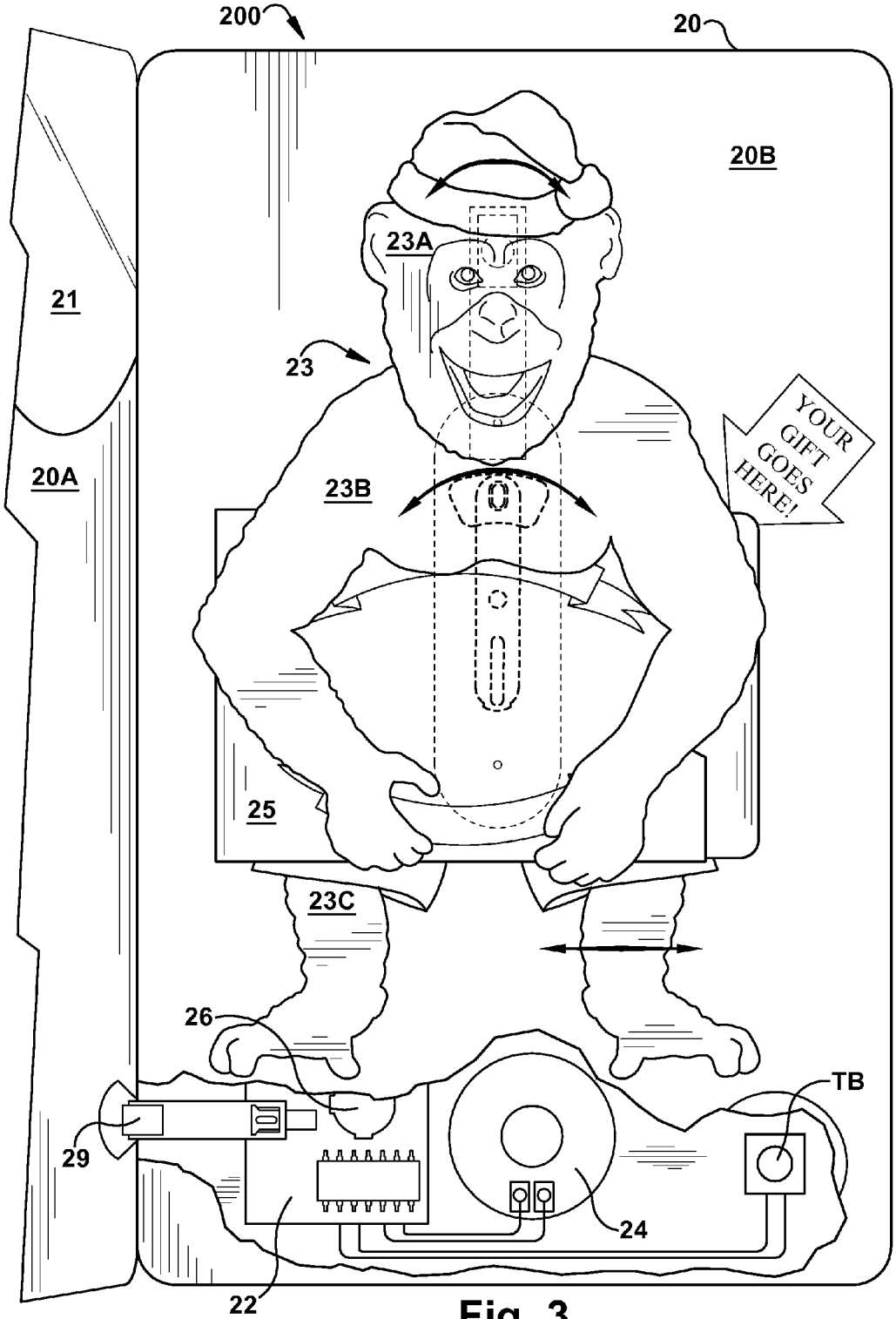
FIG. 3 is a front view of the inside of a second embodiment of the present invention.
Figure 4:
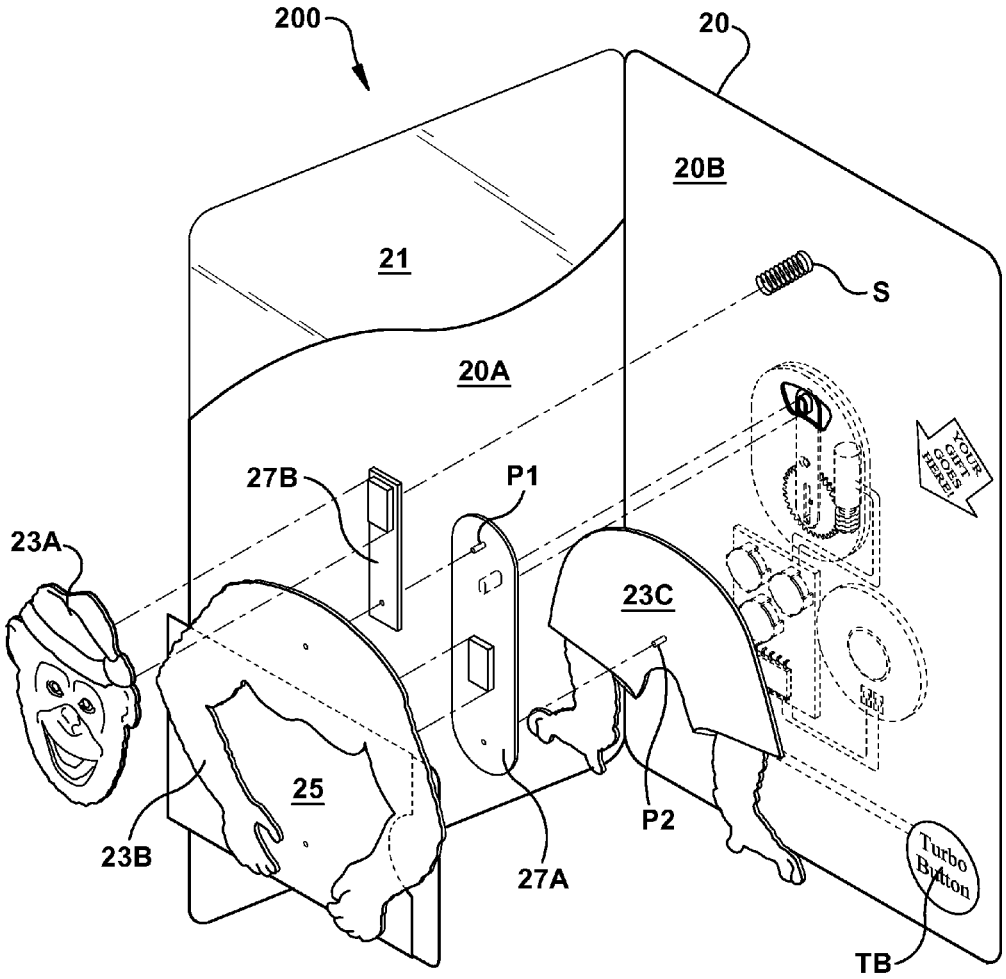
FIG. 4 is an exploded view of the gift card holder of FIG. 3.
Figure 6:
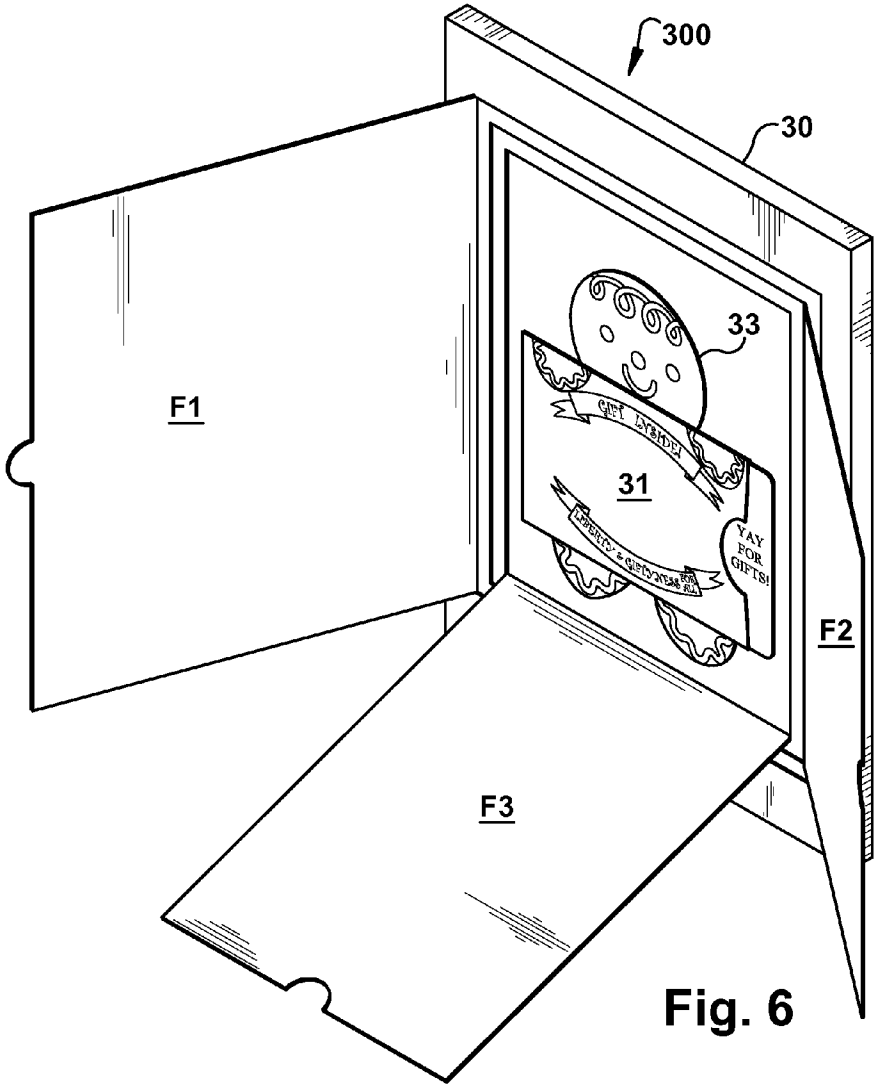
FIG. 6 is a perspective view of the gift card holder of FIG. 5, in an open position.
Figure 5:
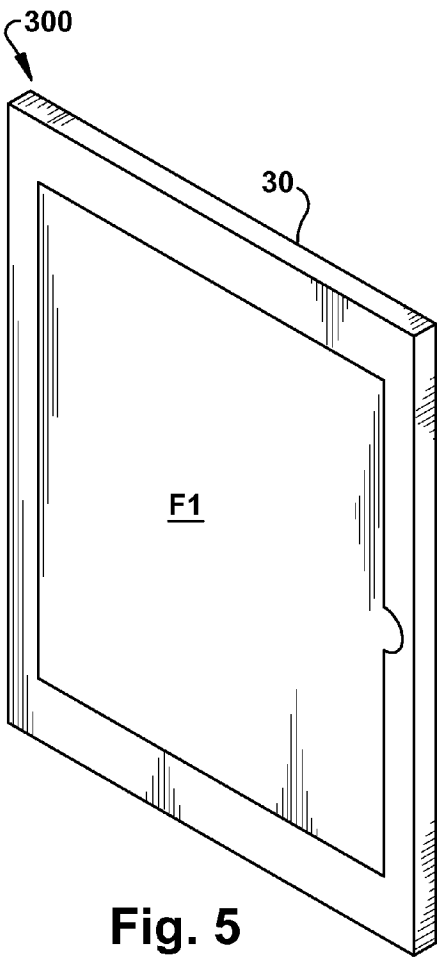
FIG. 5 is a perspective view of a third embodiment of the present invention, in a closed position.
Figure 7:
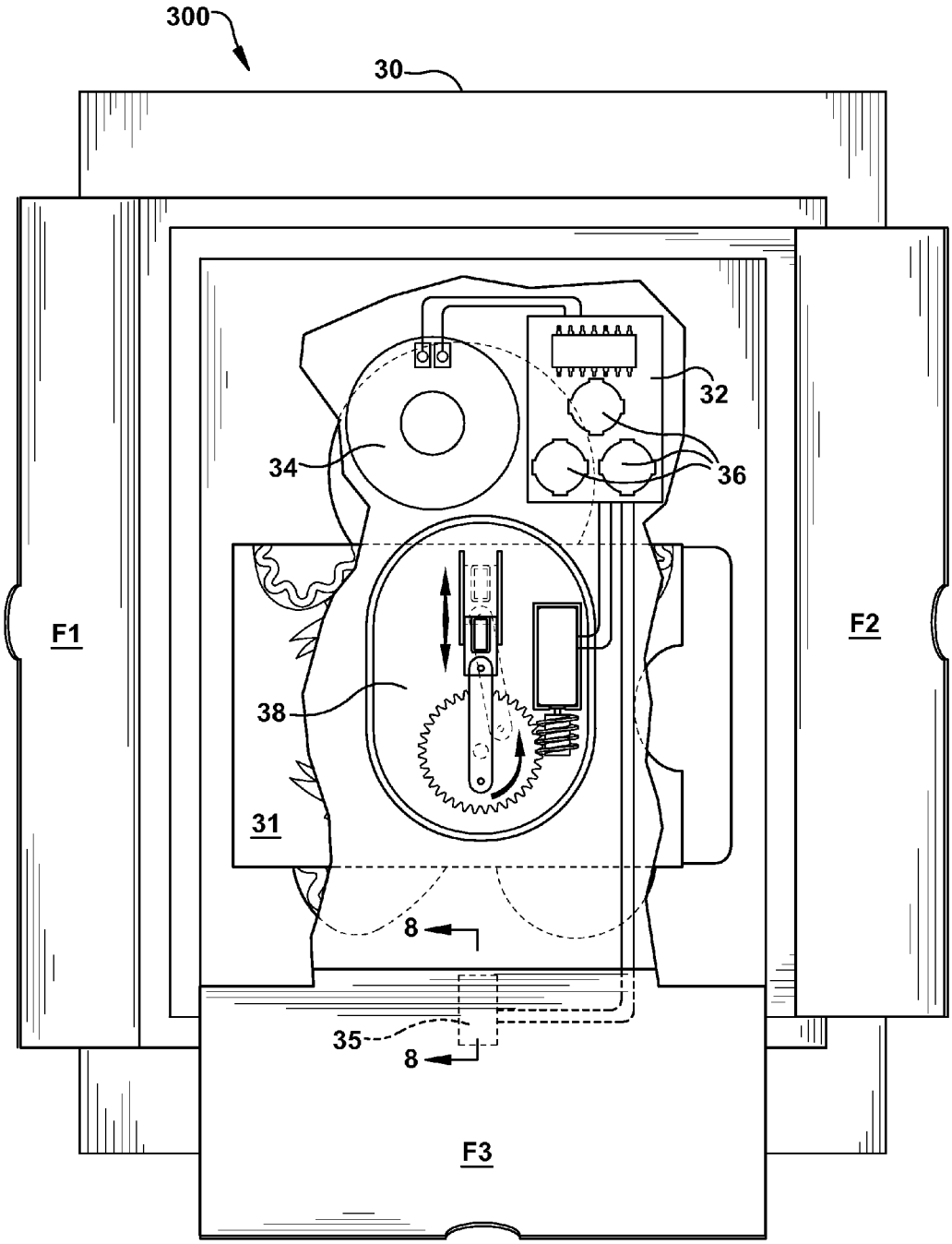
FIG. 7 is a front tear-away view of the gift card holder of FIG. 5.

In a second embodiment, shown in FIGS. 3 and 4, similar to the first embodiment described directly above, the gift card holder of the present invention is also in the form of a traditional greeting card 20. Each panel contains a front surface and a rear surface opposite the front surface. A first panel 20A is attached to a second panel (not shown) along a first fold line and a third panel 20B is attached to the second panel along a second fold line. The third (rightmost) panel 20B is folded over the second (center) panel about the second fold line such that the front surface of the third panel 20B is facing the front surface of the second panel. The third panel 20B is attached, adhesively or otherwise, to the second panel about each free perimeter edge, creating a closed pocket or cavity therebetween. The rear surface of the first panel 20A serves as the front cover of the greeting card 20 as it is folded over the second and third panels 20B (which are attached) along the first fold line. The front surface of the first panel 20A serves as the inside left panel of the greeting card 20. The rear surface of the third panel 10B serves as the inside right panel of the greeting card 20 and the rear surface of the second panel serves as the back or rear cover of the greeting card 20. The first panel (or front cover of the greeting card) 20A be smaller than the second and third 20B panels such that a portion of the inside right panel (or something attached thereto) is visible from the front of the closed greeting card 20. In a preferred embodiment, a transparent panel 21 is attached to an upper portion of the first (or front) greeting card panel 20A. As mentioned above with respect to the first embodiment, various electronic components of the greeting card are contained within the closed pocket or cavity created between the second and third greeting card panels. The electronic components may include, but are not limited to: a printed circuit board 22, an integrated circuit chip, a speaker 24, a switch, a power source such as one or more batteries 26, a motor 28, a memory device and related circuitry and wiring. Any other component which is required to or which facilitates audio capabilities, motor movement, or any other special effect, such as lighting, may be included, such components being known to one having skill in the art. A mobile object 23 is attached to the motor 28 through an opening on the third panel (or inside right panel) 20B of the greeting card 20. The mobile object 23, in this embodiment is two or more die cut shapes which are shaped, printed and arranged to resemble an animal, character or other animate object (e.g., a monkey, a dog, a clown, a cartoon character, a celebrity, a car, an airplane). As an example, as shown in FIGS. 3 and 4, the mobile object 23 includes three die-cut shapes which are attached, either directly or indirectly, to a motor 28. In the example shown, there is a first die cut shape 23A (resembling the head of a monkey) which is attached to a second die cut shape 23B (resembling the arms and upper torso of a monkey) and a third die cut shape 23C (resembling the legs and of a monkey). The second die cut shape 23B and the third die cut shape 23C are each separately attached to the motor 28 (in this example, via a backing panel 27A and attachment arm 27B) at separate pivot points P1, P2. The pivot points P1, P2 allow the die cut shapes 23A, 23B, 23C to separately move when the motor 28 is activated. The first die cut shape 23A is also independently attached to the greeting card 20 via a spring S or other attachment mechanism which still allows for movement of the first die cut shape 23A. A gift card sleeve 25 is attached to the second die cut shape 23B, the gift card sleeve 25 being generally rectangular with four closed sides and one open side along the right side thereof. The gift card sleeve 25 is dimensioned to fit a traditional or standard-sized gift card (slightly larger than the standard sized gift card). The gift card can easily be inserted and removed from the sleeve 25 via the one open side of the sleeve 25. The gift card sleeve 25 is attached to the second die cut shape 23B (which resembles the monkey's arms) to appear as though the monkey is holding the gift card sleeve 25 (and gift card therein). The motor 28 may be activated upon opening the greeting card 20. A slide switch 29 may be located across the first fold line between the first and second greeting card panels such that when the greeting card 20 is opened, the motor 28 is activated. The slide switch 29 may also control activation of a sound module which is operative to store and playback at least one audio file. The audio file, mobile object 23 and greeting card 20 may be coordinated to convey a particular theme. For example, the mobile object 23 resembles a monkey while the audio file contains sounds of a monkey. The greeting card 20 may contain artwork or other printing thereon in keeping with the monkey theme. In an alternate embodiment, the sound module and motor 28 may be controlled by separate switches. The inside of the greeting card 20 may additionally contain a push button or "turbo" button TB, which when pressed, increases speed of the motor 28 and mobile object 23. The speed of the audio replay may also increase in response to the user pushing the "turbo" button TB. Pressing the "turbo" button TB a second time, slows the motor 28 and audio back to the original speed. The greeting card 20 may contain printing thereon indicating the location of the "turbo" button TB so the user is aware that pushing on that area of the greeting card 20 will cause further entertaining effects. Closing the greeting card 20 will cause deactivation of the motor 28 and sound module. While the mobile object 23 has been described herein as having three die cut shapes 23A, 23B, 23C connected to a motor 28 two separate pivot points P1, P2, the mobile object 23 may contain any number of die cut shapes and the shapes may be attached at one or more pivot points. The die cut shapes may be attached directly to the motor 28 or they may be attached to a backing panel 27 which is attached to the motor 28 or to a connecting arm between the motor 28 and backing panel 27. This embodiment may also be used on a gift bag. The gift bag may be of the traditional sort having four side panels, one closed end and one open end for the insertion and removal of a gift or other item therein. At least one of the four side panels may be double walled with a cavity between the two walls of the panel wherein a motor and other electronic components (mentioned above) may be contained. The mobile object and gift card sleeve may be attached to the motor through an opening in the greeting card panel such that the mobile object and give card sleeve are contained on an outside surface of the gift bag, preferably on the front face of the gift bag. A switch, such as a push-button switch may be used to activate the motor and optional sound module.

Other switches may be used in place of the push-button switch. In an alternate configuration, this embodiment may also be contained within a gift box instead of greeting card or gift bag.

Figure 8:
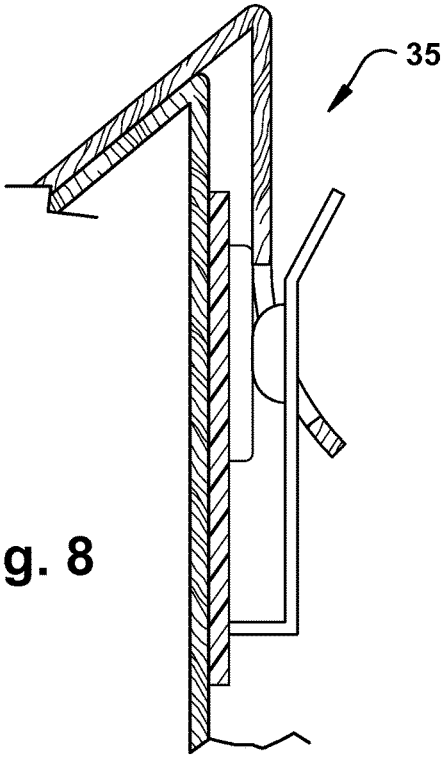
FIG. 8 is a profile view of the switch of the gift card holder of FIG. 5, in a first position, from the perspective of arrows 8-8.
Figure 9:
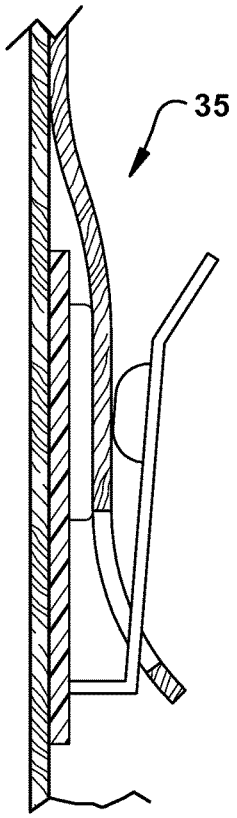
FIG. 9 is a profile view of the switch of the gift card holder of FIG. 5, in a second position.
Figure 10:
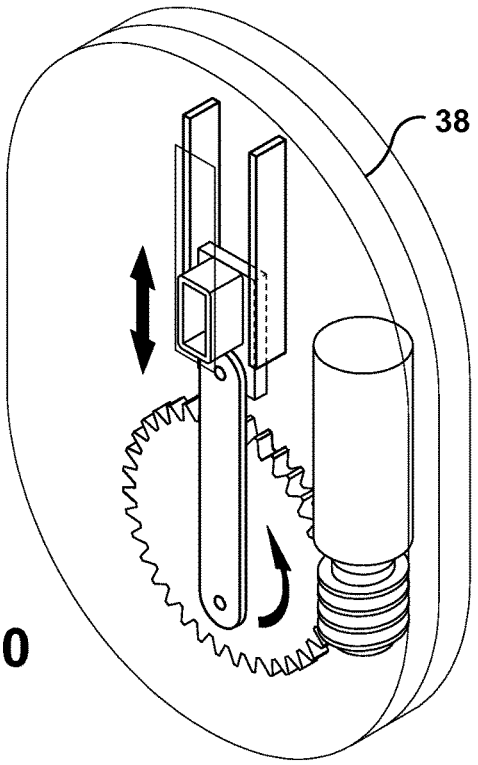
FIG. 10 is a perspective view of the motor of the gift card holder of FIG. 5.

In a third embodiment, shown in FIGS. 5 through 10, the gift card holder of the present invention is also in the form of a greeting card. This greeting card 30 contains various doors or flaps thereon which can be opened in a particular sequence such that when the last door or flap is opened a gift card sleeve 31 (for holding a gift card) is revealed and said gift card sleeve 31 is set in motion. Audio may also be initiated upon opening the last door or flap. In a preferred embodiment, the greeting card 30 contains multiple greeting card panels which are wrapped and attached about a frame. The frame is substantially rectangular-shaped and in a preferred embodiment is made of foam but can be made of cardboard, paperboard or other lightweight material. Electronic components of the greeting card are contained on the inside of the frame beneath the greeting card panels which cover the entire frame. The electronic components may include, but are not limited to: a printed circuit board 32, an integrated circuit chip, a speaker 34, a switch, a power source such as one or more batteries 36, a motor 38, a memory device and related circuitry and wiring. Any other component which is required to or which facilitates audio capabilities, motor movement, or any other special effect, such as lighting, may be included, such components being known to one having skill in the art. The front face of the greeting card contains a flap F1 (also referred to herein as a "door") thereon which covers a significant portion of the front cover of the greeting card 30. The flap F1 may contain a semi-circular tab thereon for gripping to open the flap F1. Opening the first flap F1 reveals a second, smaller sized flap F2. Opening the second flap F2 reveals a third flap F3. Opening the third flap F3 reveals a mobile object 33 with a gift card sleeve 31 attached thereto. Opening the third flap F3 causes activation of a motor 38 which is attached to the mobile object 33. It may also activate a sound module which is operative to store and replay at least one audio file. The first F1, second F2 and third F3 flaps may all be part of the same panel which are cut and folded into a stacked arrangement. Each flap F1, F2, F3 may be opened in different directions. For example, in a preferred embodiment, the first flap F1 is opened by folding the first flap F1 from left to right, the second flap F2 is opened by folding the second flap F2 from right to left and the third flap F3 is opened by folding the third flap F3 in a downward direction. Each of the three flaps F1, F2, F3 may contain portions of a greeting or message thereon or may contain other sequential or random printing or artwork thereon. A slide switch 35 is attached to the third F3 or final flap such that when that flap F3 is opened or folded downward, the slide switch 35 activates the motor 38, causing movement of the mobile object 33 (and gift card sleeve 31) and also activating the sound module causing replay of the at least one audio file through the speaker 34. As shown in FIG. 9, when the third flap F3 is in a first or closed position, the tongue portion 35A of the side switch 35 is inserted between the two electrical contacts 35B, 35C, thereby breaking the circuit. When the third flap F3 is opened or folded downward, the third panel F3 pulls the tongue portion 35A of the slide switch 35 from between the two electrical contacts 35B, 35C, thereby completing the circuit, activating the motor 38 and sound module, as shown in FIG. 8. In a preferred embodiment, the mobile object 33 moves in an up-and-down or "bouncing" motion but the mobile object 33 may move in any patter such as back-and-forth, vibrating motion, etc. A gift card sleeve 31 is attached to the front surface of the mobile object 33 and appears as though the character depicted on the mobile object 33 is holding or carrying the gift card sleeve 31. The gift card sleeve 31 is basically rectangular having three closed sides and one open side along the right side of the sleeve 31 for the insertion and removal of a traditional, standard sized gift card. While this embodiment has been described herein as having three flaps or doors F1, F2, F3, any number of flaps may be used and the flaps can open in the same or different directions. This embodiment may also be used with a gift bag. The gift bag may be of the traditional kind having four closed side panels, one closed end and one open end for the insertion and removal of a gift or other item therein. At least one of the side panels of the gift bag may be double-walled having a cavity therebetween wherein the motor and other electronic components (mentioned above) may be contained. The flaps are contained on an outside surface of the gift bag, preferably the front face of the gift bag. The gift card or gift card sleeve may be attached to the motor through an opening in the gift bag. A push button switch or other type of switch may be used to activate the motor and optional sound module. In an alternate configuration, this embodiment may also be contained within a gift box instead of greeting card or gift bag.

Figure 12:
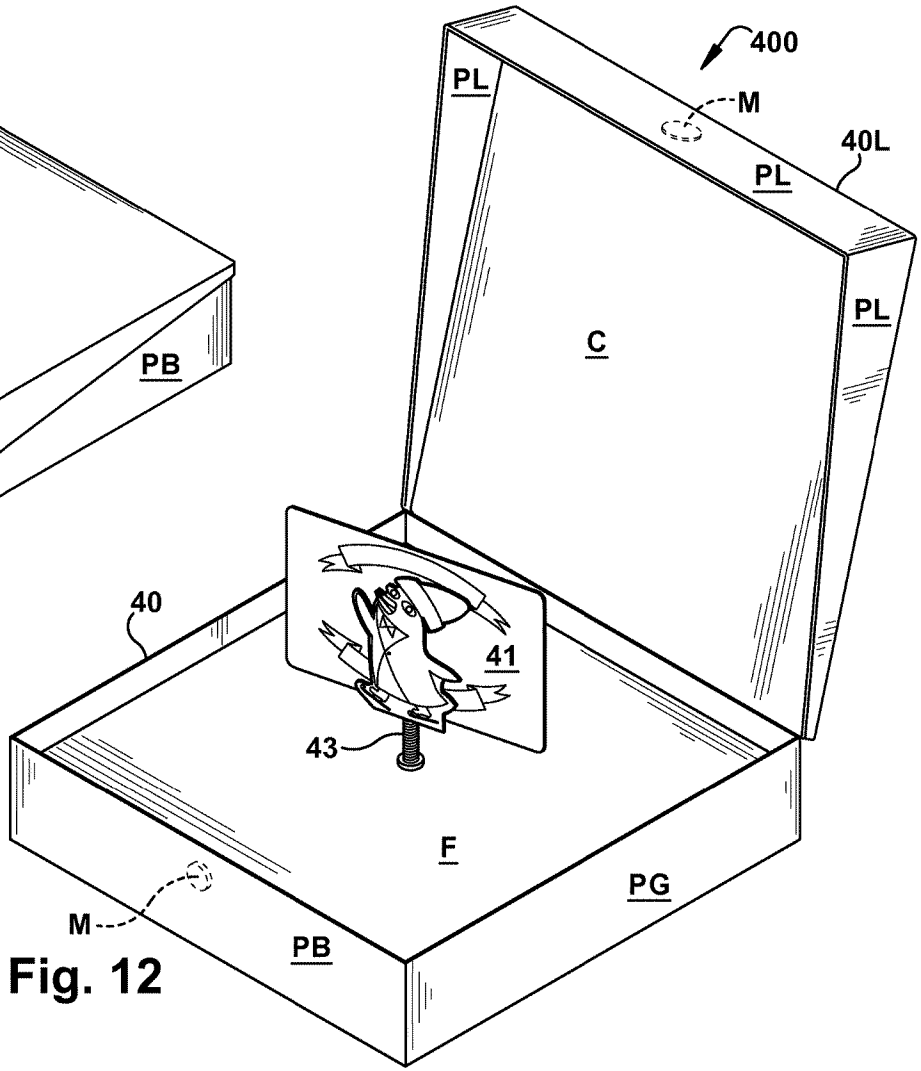
FIG. 12 is a perspective view of the gift card holder of FIG. 11, in an open position.
Figure 11:
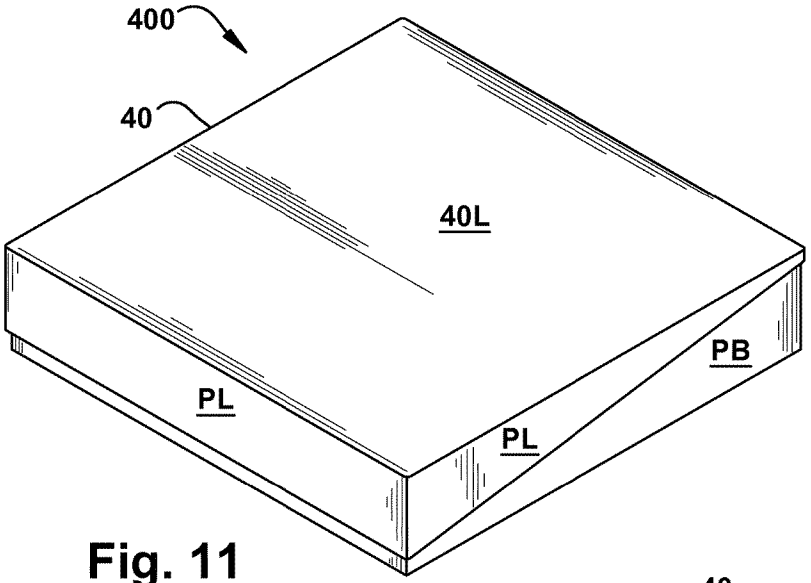
FIG. 11 is a perspective view of a fourth embodiment of the present invention, in a closed position.
Figure 13:
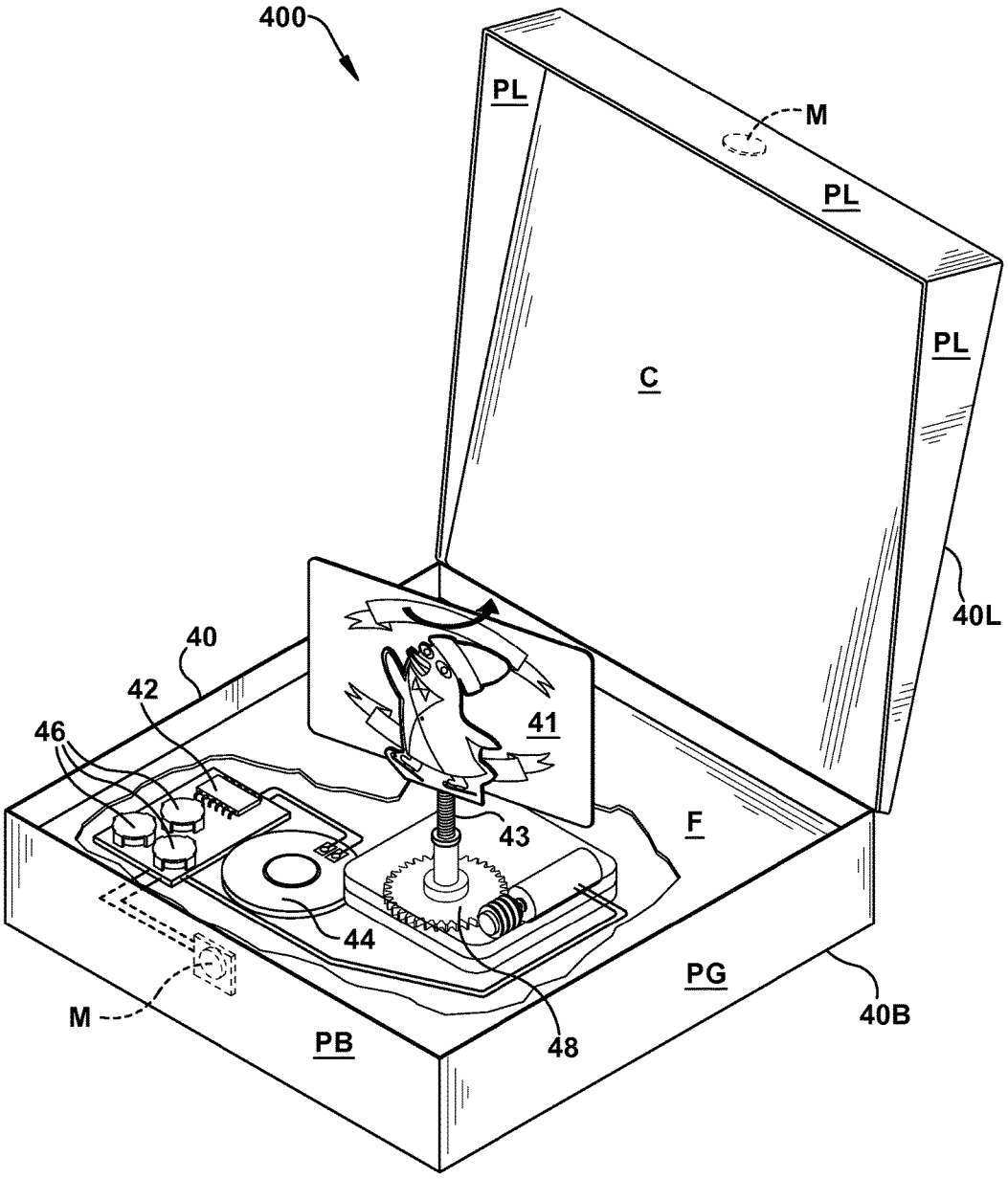
FIG. 13 is a perspective tear-away view of the gift card holder of FIG. 11.
Figure 14:
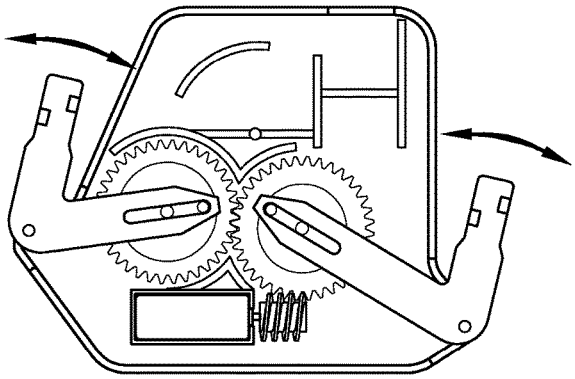
FIGS. 14 through 17 are alternate motors which can be used in any of the four gift card holder embodiments of the present invention.
Figure 15:
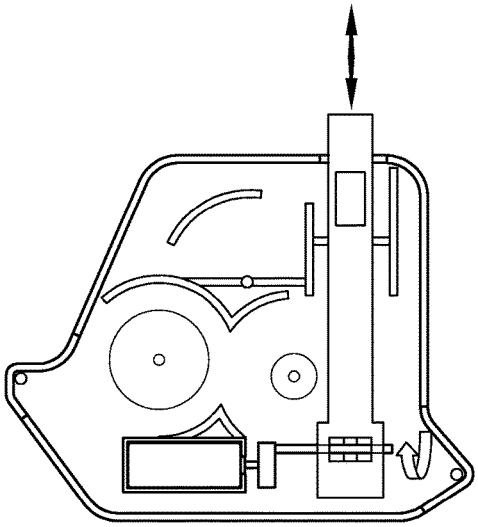
Figure 16:
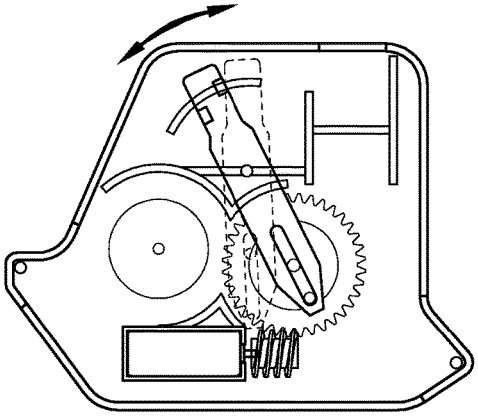
Figure 17:
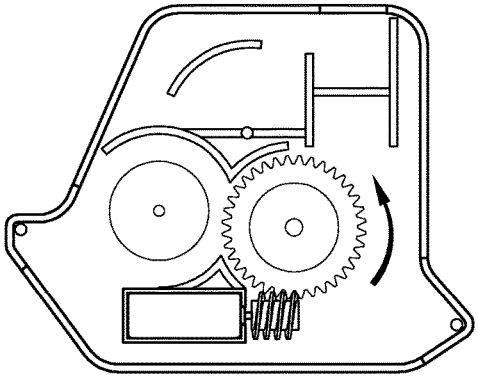

In a fourth embodiment, shown in FIGS. 11 through 13, the gift card holder is in the form of a box. The box 40 contains a hinged lid L which when opened reveals a gift card (or gift card sleeve with gift card contained therein) 41 attached to a rotating spring 43 at the center of the box 40. The box 40 contains a box portion 40B and a lid 40L attached to the box portion 40B. The box portion 40B contains four perimeter sides PB which extend upward from a bottom panel (not shown) of the box 40. A floor panel F which extends perpendicularly between the four perimeter sides PB of the box portion 40B, creates a small hidden compartment between the bottom panel (not shown) of the box 40 and the floor panel F which contains the electronic components of the gift card holder 400. The electronic components may include, but are not limited to: a printed circuit board 42, an integrated circuit chip, a speaker 44, a switch, a power source such as one or more batteries 46, a motor 48, a memory device and related circuitry and wiring. Any other component which is required to or which facilitates audio capabilities, motor movement, or any other special effect, such as lighting, may be included, such components being known to one having skill in the art. The compartment is covered by the planar floor panel F having an opening thereon through which the spring 43 exits. The floor panel F can be have printing or other indicia thereon which matches or is coordinated with the theme of the gift card holder 400. A spring mechanism 43 is attached at one end to a motor 48 contained in the hidden compartment beneath the floor panel F of the box 40. A u-shaped channel 55 or clip, which is operative to removably contain a gift card (or sleeve with gift card therein) 41 therein is attached to the opposite end of the spring mechanism 43. The channel 55 or clip may contain die cut shapes on each side of the channel or other decorative effect, as shown in FIG. 12. The spring mechanism 43 bends and folds over (causing the gift card 41 to be in a horizontal or prone position beneath the lid 40L) when the lid 40L closed or is contained atop the gift box 40. The lid portion 40L of the box 40 contains three perimeter sides PL. Two of the perimeter sides PL, which cover the sides of the box, may be tapered from front to back, to facilitate easy opening and closing of the lid portion 40L of the box 40. Upon a user opening the box 40, the spring 43 unfolds and stands straight up (causing the gift card 41 to be in a vertical or upright position) and begins to rotate. The inside surface of the attached lid 40L portion of the box 40 contains a slightly outwardly bowed or curved panel C which facilitates the movement of the spring 43 and gift card 41 from the first (flat, folded) position, when the lid 40L is closed or atop the box portion B and the second (unfolded, upright) position, when the lid 40L is opened or removed from atop the box portion 40B. The curved inner panel C on the inside surface of the lid 40L prevents the gift card 41 from catching or interfering with the perimeter sides of the lid portion 40L of the box 40. A small magnet M may be placed inside the front perimeter side PB of the box portion 40B of the box 40 and also inside the front perimeter side PL of the lid portion 40L of the box 40. When the lid portion 40L is closed or placed atop the box portion 40B, the front perimeter of the lid PL covers the front perimeter of the box PB such that the two magnets M come into close contact thereby attracting each other and removably securing the lid portion 40L in place atop the box portion 40B. The magnets also serve as a trigger or magnetic switch. When the two magnets M are in contact, such as when the lid 40L is closed atop the box 40B, the circuit is interrupted but when the two magnets M are not in contact, such as when the lid 40L is opened or removed from atop the box 40B, the circuit is completed, thereby triggering activation of the sound and motor modules. Therefore, when the user opens the box 40 by removing the lid portion 40L from the box portion 40B, the magnetic switch activates the sound module so that the at least one audio file contained in memory in the sound module is replayed through the speaker 44 and the motor 48 is activated, thereby causing the spring mechanism 43 (and greeting card 41) to rotate. Closing the box 40, by placing the lid portion 40L back atop the box portion 40B, deactivates the motor 48 and sound module.

In all of the embodiments disclosed herein, the "gift card sleeve" may be empty for the insertion of a separately purchased gift card or may have a pre-packaged gift card contained therein. Also, instead of having a gift card sleeve for storing of a gift card therein, the gift card sleeve may be replaced by the gift card itself. The gift card may be releaseably connected to a motor or to a connection mechanism between the gift card and the motor.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A gift card holder comprising:

a multi-panel greeting card having at least one sealed cavity therein;

a mobile object comprising at least two die-cut shapes;

a gift card sleeve operative to removably contain at least one gift card; the gift card sleeve attached to the mobile object;

a motor contained within the at least one sealed cavity in the multi-panel greeting card, the motor module operative to cause movement of the mobile object and the gift card sleeve;

a switch which controls activation of the mobile object;

a push button which is operative to increase the speed of the motor;

wherein opening the greeting card activates the motor module, thereby causing movement of the mobile object and gift card sleeve and closing the greeting card deactivates the motor module.

2. The gift card holder of claim 1 further comprising a sound module operative to store and playback at least one audio file upon opening the greeting card.

3. The gift card holder of claim 2, wherein the push button is also operative to increase the speed of the playback of the at least one audio file.

4. The gift card holder of claim 1, wherein the at least two die cut shapes are each attached to the motor about two separate pivot points.

5. The gift card holder of claim 1, wherein a portion of a front cover of the multi-panel greeting card is transparent.

6. A gift card holder comprising:

a greeting card body having at least one cavity therein;

a motor module contained within the at least one cavity in the greeting card body;

a mobile object attached to the motor module;

a first switch operative to initiate the motor module;

a second switch operative to increase the speed of the motor;

a gift card holder attached to the motor module;

wherein opening the greeting card causes the first switch to initiate the motor module thereby causing movement of the mobile object.

7. The gift card holder of claim 6 further comprising a sound module having at least one audio file stored thereon.

8. The gift card holder of claim 7, wherein opening the gift card causes the switch to initiate the sound module thereby causing playback of the at least on audio file through a speaker.

9. The gift card holder of claim 7, wherein the second switch also operates to increase the speed of the audio file.

10. The gift card holder of claim 6, wherein the first switch is a slide switch.

11. The gift card holder of claim 6, wherein the second switch is a push button switch.

12. A gift card holder comprising:

a greeting card body having at least one cavity therein;

a mobile object including a gift card holder;

a motor module contained in the at least one cavity in the greeting card body and attached to the mobile object;

a first switch operative to initiate the motor module;

a second switch operative to increase the speed of the motor module;

wherein opening the greeting card initiates the motor module causing movement of the mobile object.

* * * * *